United States Patent [19]

Alberto

[11] Patent Number: 5,059,104

[45] Date of Patent: Oct. 22, 1991

[54] MELT SPINNING APPARATUS

[75] Inventor: Bacchini Alberto, Vergiate, Italy

[73] Assignee: Filteco S.p.A., Italy

[21] Appl. No.: 414,290

[22] Filed: Sep. 29, 1989

[30] Foreign Application Priority Data

Oct. 3, 1988 [IT] Italy ..... 22156 A/88

[51] Int. Cl.[5] ..... D01D 5/092

[52] U.S. Cl. ..... 425/72.2; 264/176.1; 425/464

[58] Field of Search ..... 425/72.2, 404, 464; 264/176.1, 237, 211.12, 211.13, 211.14, 169

[56] References Cited

U.S. PATENT DOCUMENTS

| | | | |
|---|---|---|---|
| 3,070,839 | 1/1963 | Thompson | 425/72.2 |
| 3,274,644 | 9/1966 | Massey et al. | 425/72.2 |
| 3,632,719 | 1/1972 | Nozawa | 425/72.2 |
| 3,824,050 | 7/1974 | Balk | 425/72.2 |
| 4,756,679 | 7/1988 | Stibal et al. | 425/72.2 |
| 4,804,511 | 2/1989 | Pieper et al. | 425/72.2 |
| 4,838,774 | 6/1989 | Balk | 425/72.2 |

FOREIGN PATENT DOCUMENTS

| | | | |
|---|---|---|---|
| 1953461 | 5/1971 | Fed. Rep. of Germany | 425/72.2 |
| 85-035444 | 8/1985 | Japan | 264/237 |

*Primary Examiner*—Jay H. Woo
*Assistant Examiner*—William J. Matney, Jr.
*Attorney, Agent, or Firm*—Wigman & Cohen

[57] ABSTRACT

A melt-spinning apparatus includes a feed device for feeding a molten polymer composition from at least one extruder to a multiplicity of spinning orifices provided by a plurality of spinnerets for producing a multiplicity of discrete continuous extrudates emerging from the orifices in a generally downward direction; quenching devices for cooling the extrudates and for solidifying them to form a multiplicity of discrete continuous filaments; take-up and stretching devices provided downstream from the orifices for contacting and stretching the filaments; the quenching devices include guides for directing at least one stream of a cooling gas having a quenching temperature onto a portion, at least, of the extrudates; the orifices or spinnerets are arranged to form an annular array and a portion, at least, of the quenching devices is provided to direct the cooling gas stream in a substantially radial manner onto the extrudates that emerge from the orifices in the annular array.

20 Claims, 3 Drawing Sheets

MELT SPINNING APPARATUS

FIELD OF THE INVENTION

This invention generally relates to production of yarns, preferably, but not exclusively, for textile use such as for manufacture of garments, carpets, etc. by melt-spinning, i.e. by extrusion of a polymer composition in a molten state from spinning orifices, solidification of the extrudate(s) so produced, and drawing of the latter to form filaments, normally in the form of multifilaments that may, but need not, become textured.

DESCRIPTION OF THE PRIOR ART

Production of filament yarns by melt-spinning of such typical polymers as polyamides, polyesters and, more recently, polyalkylenes is an established technology. A limiting factor of the production rate in melt-spinning is solidification of the extrudates, and some form of cooling is normally required. A preferred method of cooling is that by means of a fluid quenching medium that is brought into contact with the extrudates during their passage from the spinning orifices to the point of first contact with a deflector, drawing roller or the like solid device of the subsequent processing stage. "Quenching" as used herein refers to a cooling mechanism operating at very high cooling rates in the range needed, for example, to cool a molten polymer mass for solidification thereof, say from 200° C. to 100° C., within a period of time of, typically, less than one second.

While use of liquids, e.g. water, is feasible for quenching in some instances, the use of a quenching gas, such as cool air, is frequently preferred, notably when controlled quenching is essential, such as when extruding polyalkylenes, e.g., polypropylenes, which are prone to spinning resonance as explained, e.g. in U.S. Pat. No. 4,347,206.

Representative art in this field can be found e.g. in European Patent Applications Nos. 0 025 812 and 0 028 844 (incorporated herein by way of reference insofar as general terminology is concerned) as well as in German Patent Application P 33 23 202; recent improvements have been disclosed by Applicant in their European Patent Application No. 87810568.3 (incorporated herein by reference insofar as various methods of drawing are concerned).

Spinning orifices for production of multifilament yarns are frequently provided by die means including perforated plates or discs termed "spinnerets" and many prior art melt-spinning machines include what is generally termed a "spinning beam" or "spinneret support", i.e. a structure that is connected at its "upstream end" with the extruder or extruders; conduits for the hot molten polymer mass emerging from the extruder as well as spinning pumps and manifolds (distributors for the molten mass) may be integrated in the spinning beam but are regarded as functionally separate items here. In other words, the term "spinning beam" as used herein is intended to refer to a structure that is characterized by a plurality of spinnerets in a support. Of course, a given plant may include several such spinning beams. Generally, the spinnerets are mounted in the spinning beam such that they can be exchanged, e.g. in order to change diameter or cross-section of the filaments, or the pattern that is formed by a multiplicity of orifices in the spinneret or spinnerets of a given apparatus.

Normally, a spinning beam includes a plurality of spinnerets because typical continuous multifilament yarns are formed of a multiplicity of from about 10 to about 250 individual filaments and since a plurality of yarns, say 4, 8, 12, 16 or more, must be produced simultaneously in a plant for commercial production.

In order to achieve gas cooling or quenching of the filaments emerging from a die, or spinneret arrangement, cooling chambers are provided so that the extrudate filaments of a number of dies or spinnerets, say 3 to 6, emerge in a common cooling chamber. For economy of the cooling system, Applicants have inter alia disclosed in their above identified European Patent Application pairs of parallel chambers supplied from a common source of cooling gas, typically air at controlled temperatures of between about 0° and about 30° C. The terms "cooling" and "quenching" are used interchangeably herein.

Most operators and producers of melt-spinning machines including Applicants did believe that an essentially linear arrangement of the die means or spinnerets in the spinning beams and, hence, in the subsequent cooling or quenching chambers was best for economy of operation and structure in view of the desired uniformity and efficiency of cooling of the extrudates. In fact, according to the knowledge of Applicant, all prior art spinning beams for commercial melt-spinning that included a plurality of dies did use them in an essentially linear arrangement, e.g. spinnerets in a linear array and with a corresponding path of the extrudate streams in any subsequent quenching chamber. As a consequence of generally linear die or spinneret arrangements according to the art, the cooling air was passed through the quenching chambers in a substantially "linear" manner as well, i.e. in the form of an air stream that emanates through an essentially planar screen or perforated panel, permeates the generally rectangular cooling chamber and the line of extrudate streams from the dies, and leaves the cooling chamber through another and essentially planar screen, perforated panel or open side at the opposite side of the quenching chamber.

OBJECTS AND SUMMARY OF THE INVENTION

It has now been found according to the invention that an annular, i.e. non-linear, arrangement relative to the direction of the stream of cooling gas of the dies or spinnerets provides for surprising advantages, such as a substantial simplification of spinning beam structure, and at no sacrifice or even with improvements of cooling uniformity and efficiency.

Accordingly, it is a main object of the invention to provide a melt-spinning apparatus of the general type indicated above that can be operated with a novel type of spinning beam.

Further objects will become apparent as this specification proceeds.

Now, according to a first apparatus embodiment, the present invention provides for a melt-spinning apparatus comprising:

(A) means for feeding a molten polymer composition from at least one extruder to a multiplicity of spinning orifices for producing a multiplicity of discrete continuous extrudates emerging from the orifices in a generally downward and preferably essentially vertical direction;

(B) quenching means for cooling the extrudates and for solidifying them to form a multiplicity of discrete continuous filaments; the quenching means including means for directing one stream, at least, of a cooling gas, preferably air, having a quenching temperature of typically in the range of from about 0° C. to about 30° C. onto at least a portion of the extrudates; and (C) take-up and stretching means provided downstream from the orifices for contacting and stretching the filaments.

According to the invention, a portion, at least, of the orifices is arranged to form an annular array, and a portion, at least, of the quenching means is provided to direct the at least one stream of cooling gas in a substantially radial manner onto the extrudates that emerge from the spinning orifices in the annular array so as to provide for an essentially simultaneous and uniform quenching of all extrudates directed by that array.

Preferably, all spinning orifices are provided by a number of conventional spinnerets in an annular and preferably circular array or pattern when viewed from their downstream ends, i.e. those situated within or near the quenching means. Generally, from 3 to 30 or more spinnerets, preferably from about 6 to about 18 and typically about 12 spinnerets are arranged in the pattern of a regular polygon or circle defined essentially by the geometrical centers of the end face of each spinneret and a common center in the plane of their downstream faces. Preferably, all orifices or spinnerets provided in any annular array are aligned in a common horizontal plane which, in turn, intersects at an angle of about 90° with the axis of extrusion of each orifice or spinneret.

While commercially available circular spinnerets are preferred for many purposes, substantially rectangular or other type of spinnerets could be used. By the same token, the patterns and/or diameters and/or shapes of the orifices of each spinneret can be chosen as required in view of the specification of the yarns that are to be produced.

According to the invention, the quenching is effected by cooling in "a radial manner" (or "radial cooling" for short) and these terms are intended to refer synonymously to a stream of cooling gas that either originates from a central location and expands in all radial directions towards a periphery of the central location, or to a stream that originates at a periphery and is directed toward the center thereof.

It should be noted that the term "radial" is intended herein with reference to any plane that intersects perpendicularly with the direction of extrudate emergence, and that the concept of radial cooling according to the invention implies an "axial" extension of the quenching zone as well. In other words, the stream of cooling gas according to the invention should have an essentially cylindrical flow profile of the type generated between a pair of elongated theoretical coaxial cylinders of different diameters where each of said cylinders is permeable to gas and where a gas pressure differential is maintained between adjacent surfaces of the cylinders.

Another way of illustrating radial cooling as contemplated by the invention is to regard the multiplicity of discrete extrudates in annular array as a tubular curtain (which may have a "thickness" if formed by a number of adjacent spinnerets in an annular or circular array within a spinning beam) and where the cooling air stream originates from within the curtain streaming out, or outside of the curtain and streaming in.

As a matter of theory, both directions, i.e. from the inside out or from the outside in, are believed to be operable according to the invention but for practical purposes the former arrangement (from inside out) is generally preferred.

Thus, a preferred melt-spinning apparatus comprises a quenching means that includes an elongated and preferably tubular chamber in an essentially coaxial position relative to the annular array and having at least one essentially tubular inner chamber wall member positioned radially within the annular array, and at least one outer chamber wall member positioned radially outside of said array. Such an arrangement could provide for either direction of radial cooling from the inside out or vice versa depending upon whether the gas stream is introduced at an overpressure of typically in the range of from 1 to 100 mbar from within the inner chamber wall member and/or supported by suction applied at the opposite side, or whether an inverse direction is caused by applying suction from within the inner chamber wall member and, if desired, pressure from the outside of the inner chamber.

In view of the preference of radial cooling from the inside out, the inner chamber wall member is connected to a source of cooling gas and has at least one wall portion that is permeable to the cooling gas while the outer chamber wall member is connected to an outlet duct for said cooling gas and is impermeable thereto.

The tubular quenching chamber provides for another advantage of the inventive apparatus termed "compartmented emergence of cooling air" as explained in more detail below. Preferred compartments are one on top of each other in the axial direction of a tubular quenching chamber, e.g. as horizontally segmented portions of a generally cylindrical body.

It has been found according to the invention that the structure and operation of a spinning beam that holds a number of spinnerets in an annular array plus radial cooling provides for savings in apparatus and maintenance costs to the extent of reducing them significantly, say by one half. At the same time, cooling efficiency and uniformity of prior art melt-spinning machines can at least be equaled or improved.

While not wishing to be bound by any theory, it can be assumed that the radial or cylindrical expansion of a cooling gas that is typical for the most preferred embodiments of the invention provides for improved cooling uniformity and efficiency either because an expanding gas will become cooler due to such expansion or because of improved heat exchange between a radially flowing quenching gas and a hot extrudate. Such improvements are of notable advantage when melt-spinning polypropylene.

Generally, an essentially symmetrical structure of the spinneret array and of the quenching means will be preferred for many purposes and this includes a mutually equidistanced position of the spinnerets in a common annular array and in coplanar alignment.

It is to be noted that production of continuous multifilament yarns with or without bulking, entangling, texturing and the like, notably from polypropylene and other polymers that may be problematic for processing with prior art machines, constitutes a preferred embodiment of the invention. However, both type and extent of drawing including the processing variations disclosed in the above mentioned patents and patent applications as well as other methods can be operated in combination with the invention. Further, while continuous multifilament yarns, both mono- and polychromatic, are a preferred product obtained according to the present teaching, the invention can be applied advantageously to the production of yarns made from staple fibers insofar as the latter are produced by cutting a continuous material obtained by radial cooling as taught and claimed herein.

BRIEF DESCRIPTION OF THE DRAWINGS

The invention will be explained in more detail with reference to the annexed drawings showing specific embodiments for illustration, not limitation and in which.

DETAILED DESCRIPTION OF THE DRAWINGS

Figure 1:
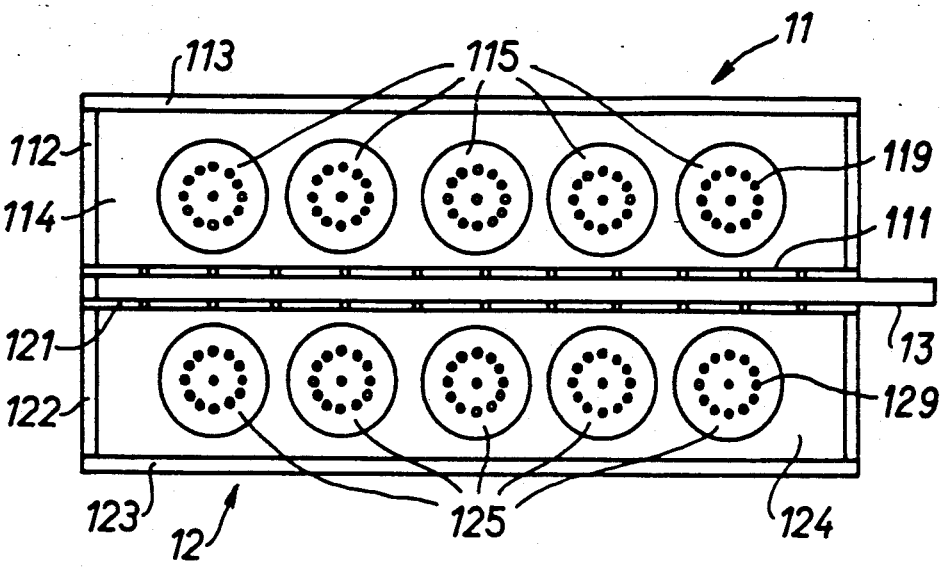
Fig. 1 PRIOR ART
FIG. 1 is a diagrammatic plan view of the spinnerets in a linear arrangement according to prior art.

The diagrammatic plan view of FIG. 1 shows a linear arrangement of the spinnerets in the spinning beam of a melt-spinning apparatus according to prior art as illustrated, for example, in FIG. 1A of European Patent Application No. 87810568.3 by the same Applicant.

A pair of quenching chambers 11, 12 is shown in FIG. 1 in cross-section and includes a common conduit 13 for connection of both chambers 11, 12 with a common source of quenching air at a temperature between about 10° and 20° C. and at a moderate overpressure (e.g. 20 to 30 mbar) relative to ambient pressure. Each cooling chamber 11, 12 is essentially formed by an air-permeable or perforated back wall 111, 121, a pair of side walls 112, 122 and front walls 113, 123 which may be hinged as chamber doors but which in any case will permit passage of air. The top of each chamber 11, 12 is formed by an essentially horizontal plate 114, 124 each supporting five spinnerets 115, 125 in linear arrangement according to the state of the art.

In operation of a melt-spinning apparatus with a spinning beam of this type, quenching air will be passed through conduit 13 into each chamber and pass through the air-permeable wall 111, 112 into contact with the extruded filaments (not shown) that emerge through the orifices 119, 129 as strings of molten polymer that will solidify progressively upon passage through the length of the quenching chamber because of heat-exchange with the quenching air. The orifices 119, 129 of all spinnerets 115, 125 are directed "downward", that is, substantially vertical into each chamber 11, 12 towards a first drawing roll (not shown) which operates at a peripheral speed that is somewhat higher than the speed of filament emergence at the orifices 119, 129. The number of orifices and their array are but for illustration since a typical spinneret will normally have more orifices.

As will be understood from this illustration, the general direction of the quenching air according to the art is "linear" in that it will emerge from the chambers via air-permeable front walls 113, 123 thereof essentially in the same direction in which in enters the quenching chambers 11, 12 via back walls 111, 121 and then passes through the filament bundles that are formed by each spinneret.

Figure 2:
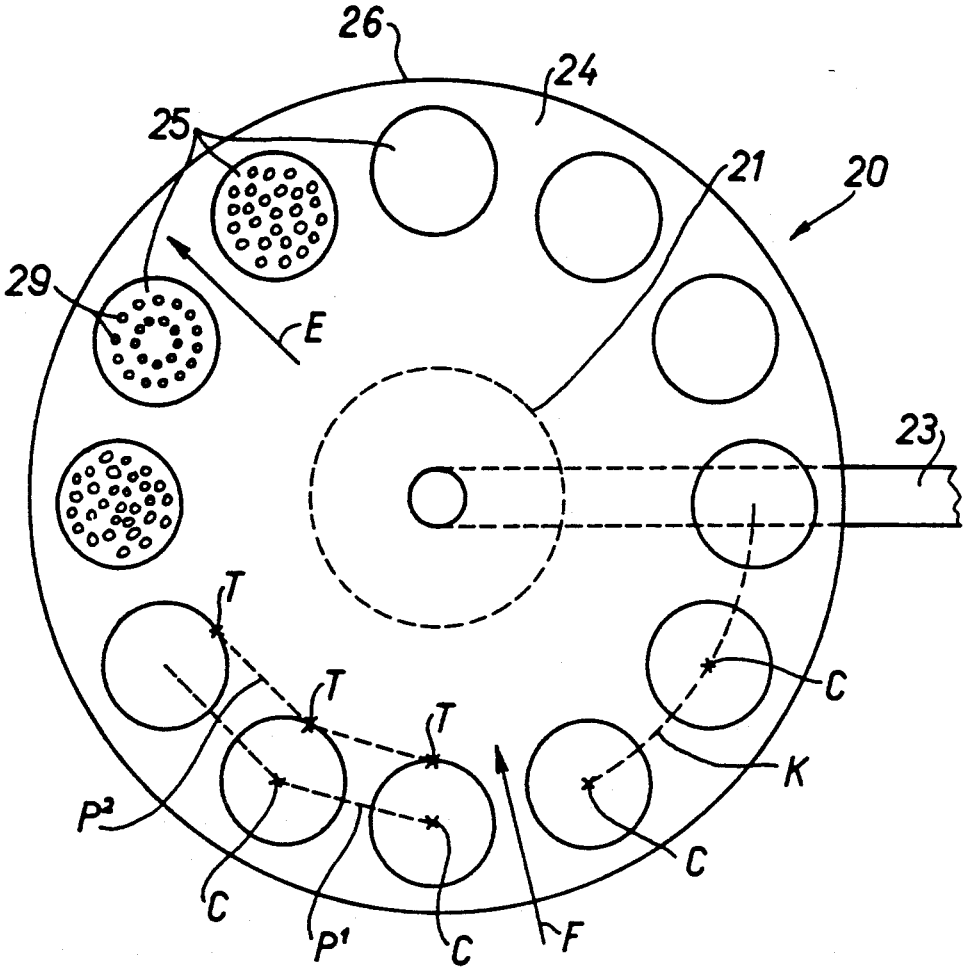
FIG. 2 is a diagrammatic plan view of an annular array of the spinnerets in a spinning beam of a melt-spinning apparatus according to the present invention.

The diagrammatic plan view of a spinning beam 20 according to the invention and shown in FIG. 2 includes a support plate 24 that carries 12 (or more or less) spinnerets 25 as seen when looking from a downstream position at the downstream ends of spinnerets 25. Spinning orifices 29 are provided in all spinnerets 25, of course, even though not shown in all of them in FIG. 2 but for simplicity.

According to the invention it is believed to be essential that the orifices or the spinnerets that contain them form an annular array which preferably is equidistant as regards the spinnerets (same distance between any two adjacent spinnerets 25) and circular. "Annularity" or "circularity" may be expressed either in that all spinnerets 25 are arranged with their geometrical centers C aligned on a common circle as indicated by broken line K, or with their centers C aligned on a polygon as indicated by the broken line $P^1$, or with any common point, e.g. adjacently common inner tangent points $P^2$ on a circular or polygonal line, or in any other manner that results in a closed annulus, preferably of a generally "circular" type in that all spinnerets of a given array are substantially equidistanced from a common center. The actual form of the annulus formed by the spinnerets need not be circular. Since the primary requirement is uniformity of cooling of all monofilaments that emerge from an array of spinnerets, "circularity" of the arrangement is predicated upon an essentially circular and coaxial arrangement of the common source of quenching gas or air for all spinnerets in that array.

For the purpose of the diagrammatic presentation of FIG. 2 the common source of quenching air for the extrudates that emerge from all spinnerets 25 is a tubular or cylindrical structure 21 illustrated by a pointed circular line to indicate air permeability due, for example, to numerous small openings or perforations, such as in a cylinder formed of a wire mesh, or a tubular structure formed by a support layer (not shown) with fewer but larger openings and an outer layer having many small openings, each of which may be surrounded or encompassed by thin and axially extending guide walls to improve laminarity of flow of a gaseous stream.

Many other tubular structures providing homogeneous flow conditions as known per se in the art of gas distribution can be used and one or more conduits 23 are provided for connection of the interior of structure 21 with a source of quenching air at some degree of overpressure, e.g. the pressure side of a blower (not shown). This will generate an essentially radial flow of quenching air in an outward direction indicated by arrow E. However, as noted above, structure 21 could be connected with the suction end of a blower so that the radial stream of quenching air would be directed inwards as indicated by arrow F. An outer tubular shell 26 can be used to form a chamber or protecting wall around the quenching zone and/or serve to guide the quenching air out of the system and/or into recirculation.

Figure 3A:
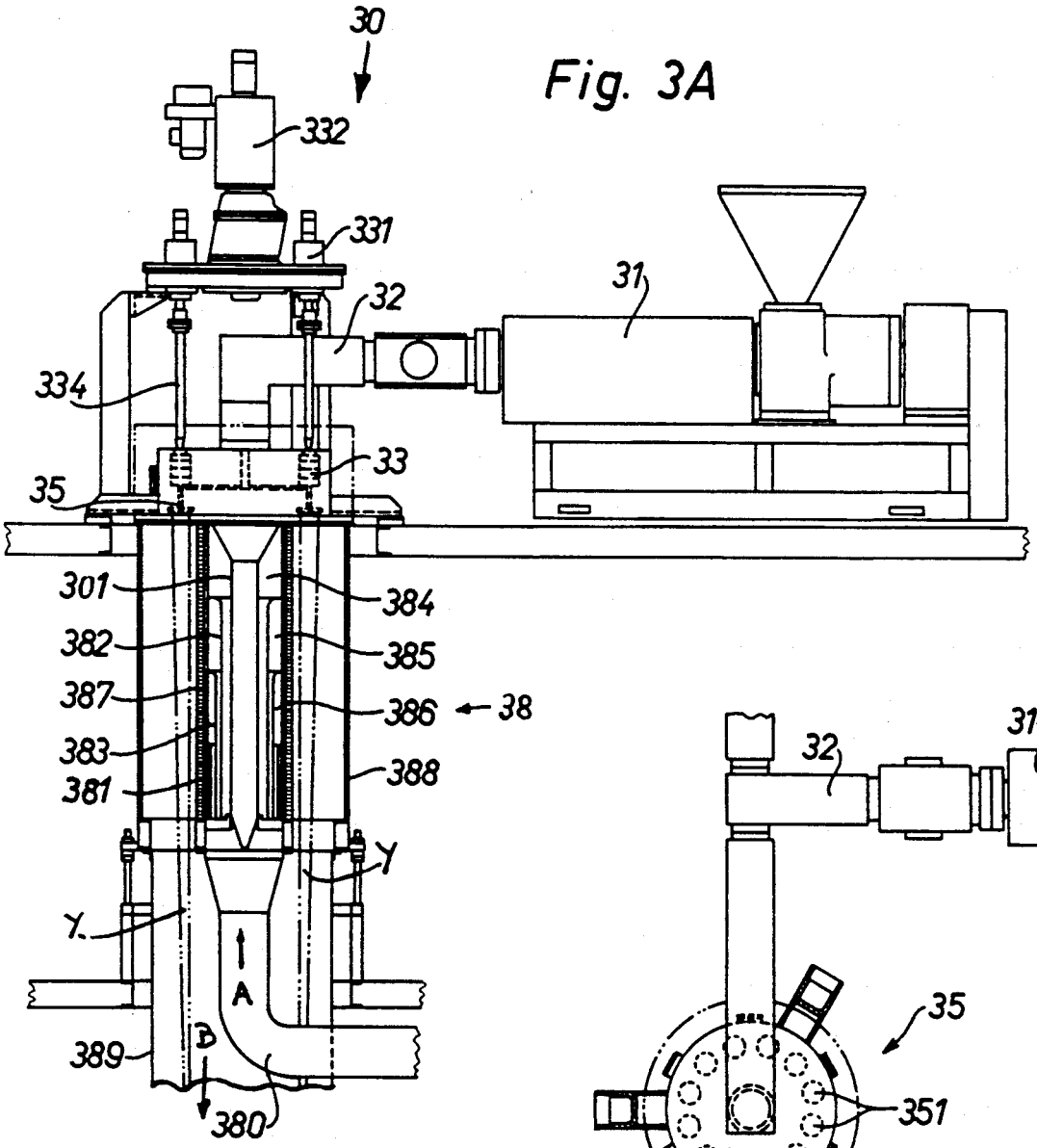
FIGS. 3A, 3B and 3C are semi-diagrammatic side and top views of a melt-spinning apparatus and parts thereof including a pair of spinning beams according to the invention.
Figure 3B:
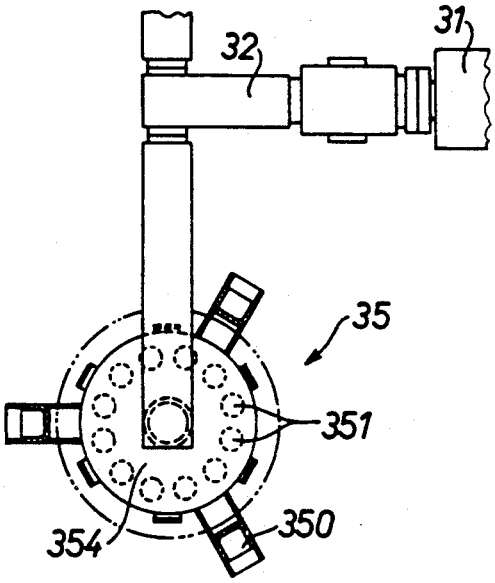
Figure 3C:
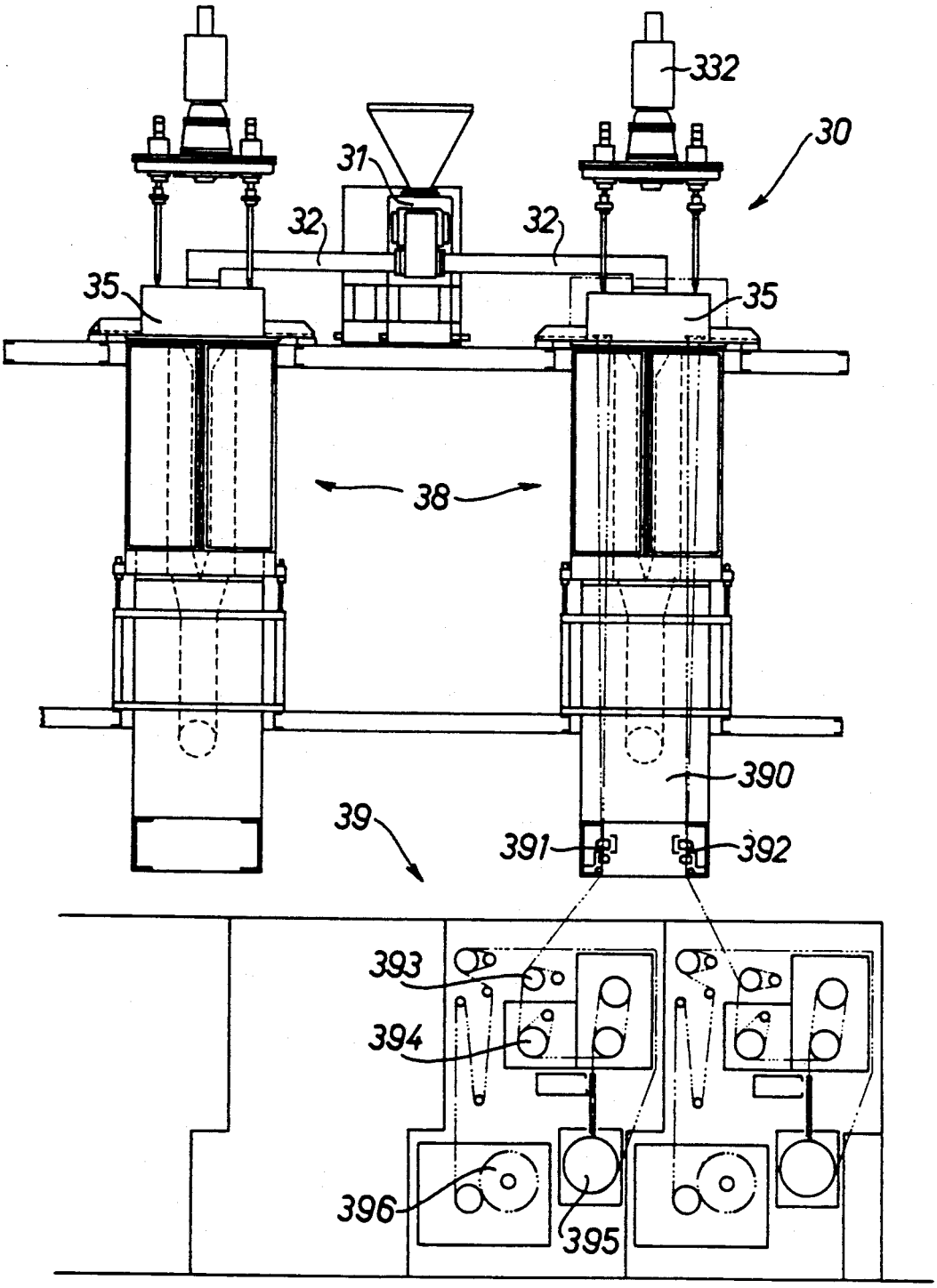

FIGS. 3A, 3B and 3C illustrate in a semi-diagrammatic manner an apparatus 30 according to the invention. The side view of FIG. 3A shows an extruder 31, a conduit 32 for the molten polymer, four spinning pumps 33 (only two are seen in FIG. 3A) actuated by pump drives 331 which, in turn, are actuated by a common main pump drive 332 and transmit their rotational energy via rods 334. As shown in the partial view of FIG. 3B, extruder 31 actually supplies molten polymer to a pair of spinning beams 35 as is best seen in FIG. 3C showing another side view of apparatus 30. The actual apparatus includes two beams as shown in FIG. 3C and thus includes 8 spinning pumps.

Each spinning beam 35 includes a plate 354 that is supported by three brackets 350 and, in turn, holds twelve spinnerets 351 in a circular arrangement. The extruded filaments Y that emerge from the spinnerets pass through a tubular structure 38 formed by a central core 301 and three coaxial tubes or ducts 381, 382, 383 so as to define three separate spaces or tubular segments 384, 385, 386 for a compartmented emergence of gaseous quenching medium or cooling gas.

Specifically, with the preferred passage of cooling gas from within the extrudates that emerge from the annular array of spinnerets outwardly through the extrudates, two, three (preferred) or more concentric ducts (of the type indicated by 381, 382 and 383) that open at differing levels one above the other may be used advantageously to provide an effective yet simple means for quenching control, because undesired temperature gradients (in axial direction) of the gaseous quenching medium can be avoided or reduced if a suitable number of compartmented areas, e.g. two, three, four or more, is used.

It has been found that the improved quenching control provided by this embodiment of the invention may contribute to significantly reduce or overcome problems of spin resonance when using the invention for melt-spinning of polypropylene.

Regardless of the number of ducts for compartmented emergence of the cooling gas, the coaxial shell for emergence of the quenching gas preferably includes a central core 301 and an air-permeable tubular structure 387 formed by thin and radially extending laminae that define a large number of uniform openings for radially directing the quenching gas or air that is passed as indicated by arrow A into structure 38 by a common feed tube 380 supplied with cool gas or air from a source (not shown), e.g. a combination of a heat exchange means and a blower means.

A tubular outer shell 388 is provided so that the used quenching air can be fed out from the system via tube 389 as indicated by arrow B.

As briefly mentioned above, further processing of the filaments emerging at the lower end 390 of the quenching zone is not of essence for the present invention. Depending upon the intended operation, the filament groups emerging from each spinneret may be combined such that one, two, three or more such groups are combined into a yarn. For the purpose of the illustration of FIG. 3 it has been assumed that three such groups of continuous monofilaments are combined into one yarn. Accordingly, four yarns emerge from end 390 and each yarn guide 391, 392 assembles one pair of yarns (of which but the frontal yarn is seen in FIG. 3C).

Accordingly, each half of device 39 will process two yarns in parallel as is conventional in this type of drawing device assumed to include two groups of drawing rollers 393, 394, an air-texturing device 395 and a winder 396.

While the particulars of the yarn processing portion at the left side of FIG. 3C have been omitted for simplicity, it will thus be apparent that a total of eight yarns each containing the filaments extruded from three spinnerets will be obtained with two spinning beams of the apparatus of FIG. 3. Thus, if each spinneret 351 would in this operating example be provided with forty orifices each so that the eight yarns produced simultaneously will each consist of 120 continuous monofilaments that may be bulked or not and used as such or be further processed by cutting or other methods to produce staple fibers or other products made of melt-spun fibers having deniers in a typical range of from 1 to 15 den per filament and at typical production speeds in the range of from 1000 to 3000 m per minute. It goes almost without saying that the spinnerets can be exchanged to provide for more and thinner monofilaments or for less monofilaments with a higher denier. In the same manner, other parameters of the spinnerets may be changed for any given apparatus.

Numerous other changes within the teaching of the present invention will be apparent to one skilled in the art and all such variations are assumed to be encompassed by the present application.

What is claim is:

1. A melt-spinning apparatus comprising:

means for feeding a molten polymer composition from at least one extruder to a multiplicity of spinning orifices for producing a multiplicity of discrete continuous extrudates emerging from said orifices in at least one annular array and in a generally downward direction;

quenching means for cooling said extrudates and for solidifying them to form a multiplicity of discrete continuous filaments; said quenching means including means for directing at least one stream of a cooling gas having a quenching temperature onto a portion, at least, of said extrudates; wherein said quenching means further comprises an elongated chamber in an essentially coaxial position relative to said at least one annular array and having at least one essentially tubular inner chamber wall member positioned radially within said annular array; and at least one outer chamber wall member positioned radially outside of said array; wherein said inner chamber wall member is connected to a source of cooling gas and has at least one wall portion that is permeable to said cooling gas while said outer chamber wall member is connected to an outlet duct for said cooling gas and is substantially impermeable thereto; and wherein said inner chamber wall member includes at least two essentially coaxial ducts having openings through which cooling gas is simultaneously introduced or removed at different axial levels of said elongated chamber means; and take-up and stretching means provided downstream from said orifices for contacting and stretching said filaments;

wherein a portion, at least, of said orifices is arranged to form an annular array and wherein a portion, at least, of said quenching means is provided to direct said at least one stream of said cooling gas in an essentially radial manner onto said extrudates that emerge from said spinning orifices in said annular array.

2. The apparatus of claim 1 wherein said spinning orifices are provided by spinnerets arranged in a spinning beam which further includes means for feeding said polymer composition to said orifices.

3. The apparatus of claim 2 wherein said spinnerets are arranged in said spinning beam so as to form said at least one annular array.

4. The apparatus of claim 2 wherein said spinnerets are provided in a mutually equidistant and essentially circular arrangement substantially aligned in a common horizontal plane.

5. The apparatus of claim 2 wherein from 6 to 18 spinnerets are arranged in said beam to form said annular array.

6. A melt-spinning apparatus including a multiplicity of spinning orifices for producing a multiplicity of discrete continuous extrudates emergent from said orifices in an axial direction and quenching means for cooling and solidifying said extrudates to form a multiplicity of discrete continuous filaments along the axial length thereof, said quenching means comprising:

a source of cooling fluid having a quenching temperature;

means for separating said cooling fluids into a plurality of separate cooling fluid streams; and means for directing said separate cooling fluid streams radially onto said extrudates in discrete axial zones along the axial dimension thereof;

wherein said means for separating comprises a plurality of essentially coaxial ducts and said means for directing comprises a lip end portion of one of said coaxial ducts such that two separate quench zones are formed.

7. Apparatus as in claim 6, wherein said lip end portion comprises a coaxial-to-radial transition of said duct.

8. Apparatus as in claim 6, wherein a plurality of concentric tubes form the coaxial ducts, and wherein said lip end portion is displaced axially from said spinning orifices.

9. Apparatus as in claim 6, wherein said multiplicity of spinning orifices are radially disposed about an axis and said plurality of coaxial ducts are disposed about the same axis.

10. The apparatus of claim 9 wherein said spinning orifices are provided by spinnerets arranged in a substantially common horizontal plane in a spinning beam so as to form said annular array.

11. The apparatus of claim 9 wherein said spinning orifices are provided by at least about 6 spinnerets provided in a mutually equidistant and essentially circular arrangement.

12. The apparatus of claim 9 wherien said spinning orifices are provided by less than about 18 spinnerets provided in a mutually equidistant and essentially circular arrangement.

13. The apparatus of claim 6, further including means for supplying molten polymer material to said spinning orifices wherein said spinning orifices are provided by spinnerets arranged in a spinning beam which further includes said means for feeding said polymer composition to said orifices.

14. A melt-spinning apparatus including a multiplicity of spinning orifices for producing a multiplicity of discrete continuous extrudates emergent from said orifices in an axial direction and quenching means for cooling and solidifying said extrudates to form a multiplicity of discrete continuous filaments along the axial length thereof, said quenching means comprising:

a source of cooling fluid having a quenching temperature;

means for separating said cooling fluids into a plurality of separate cooling fluid streams; and means for directing said separate cooling fluid streams radially onto said extrudates in a plurality of discrete axial zones along the axial dimension thereof;

wherein said means for separating comprises a plurality of essentially coaxial ducts and said means for directing comprises lip end portions of at least two of said coaxial ducts such that at least three separate quench zones are formed.

15. Apparatus as in claim 14, wherein said lip end portions comprise coaxial to radial transitions of said ducts.

16. Apparatus as in claim 14, wherein a plurality of concentric tubes form the coaxial ducts, and wherein said lip end portions are displaced axially from said spinning orifices.

17. Apparatus as in claim 14, wherein said multiplicity of spinning orifices are radially disposed about an axis and said plurality of coaxial ducts are disposed about the same axis.

18. The apparatus of claim 17 wherein said spinning orifices are provided by spinnerets arranged in a substantially common horizontal plane in a spinning beam so as to form said annular array.

19. The apparatus of claim 17 wherein said spinning orifices are provided by at least about 6 spinnerets provided in a mutually equidistant and essentially circular arrangement.

20. The apparatus of claim 17 wherein said spinning orifices are provided by less than about 18 spinnerets provided in a mutually equidistant and essentially circular arrangement.

* * * * *

UNITED STATES PATENT AND TRADEMARK OFFICE

CERTIFICATE OF CORRECTION

PATENT NO. : 5,059,104

DATED : October 22, 1991

INVENTOR(S) : Alberto BACCHINI

It is certified that error appears in the above-identified patent and that said Letters Patent is hereby corrected as shown below:

IN THE TITLE PAGE:

Item [19] "Alberto" should read --Bacchini--.

Item [75] "Bacchini Alberto" should read --Alberto Bacchini--.

Signed and Sealed this

Eighteenth Day of February, 1992

*Attest:*

HARRY F. MANBECK, JR.

*Attesting Officer*

*Commissioner of Patents and Trademarks*